US007946696B2

(12) United States Patent
Yano

(10) Patent No.: US 7,946,696 B2
(45) Date of Patent: May 24, 2011

(54) INK CARTRIDGES AND INK SUPPLY SYSTEMS

(75) Inventor: Hiroyasu Yano, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 874 days.

(21) Appl. No.: 11/933,382

(22) Filed: Oct. 31, 2007

(65) Prior Publication Data

US 2008/0129805 A1 Jun. 5, 2008

(30) Foreign Application Priority Data

Oct. 31, 2006 (JP) ..... 2006-296159

(51) Int. Cl.
*B41J 2/175* (2006.01)

(52) U.S. Cl. ..... 347/86

(58) Field of Classification Search ..... 347/84, 347/85, 86

See application file for complete search history.

(56) References Cited

U.S. PATENT DOCUMENTS

| | | | | |
|---|---|---|---|---|
| 6,390,611 | B1 * | 5/2002 | Kobayashi et al. | 347/84 |
| 6,585,358 | B2 | 7/2003 | Usui et al. | |
| 7,077,512 | B2 | 7/2006 | Kobayashi et al. | |
| 7,077,514 | B2 | 7/2006 | Inoue et al. | |
| 7,086,722 | B2 * | 8/2006 | Aruga | 347/86 |
| 7,278,722 | B2 * | 10/2007 | Sasaki et al. | 347/86 |
| 7,334,888 | B2 | 2/2008 | Sasaki et al. | |
| 7,350,909 | B2 | 4/2008 | Takagi et al. | |
| 7,661,805 | B2 * | 2/2010 | Usui | 347/92 |
| 2004/0196341 | A1 | 10/2004 | Ogura et al. | |
| 2004/0239734 | A1 | 12/2004 | Aruga | |
| 2005/0088497 | A1 | 4/2005 | Katayama et al. | |
| 2005/0134663 | A1 | 6/2005 | Sasaki et al. | |
| 2005/0140749 | A1 | 6/2005 | Usui et al. | |

FOREIGN PATENT DOCUMENTS

| | | | |
|---|---|---|---|
| CN | 1484583 | A | 3/2004 |
| EP | 0826505 | A2 | 3/1998 |
| EP | 1164025 | A1 | 12/2001 |
| EP | 1445107 | A1 | 8/2004 |
| EP | 1464502 | A1 | 10/2004 |
| EP | 1674270 | A1 | 6/2006 |

(Continued)

OTHER PUBLICATIONS

Japanese Patent Office, Notice of Reasons for Rejection for Japanese Patent Application No. 2006-296159 (counterpart to above-captioned patent application), mailed Nov. 26, 2008.

(Continued)

*Primary Examiner* — Anh T. N. Vo
(74) *Attorney, Agent, or Firm* — Baker Botts L.L.P.

(57) ABSTRACT

An ink supply system includes an ink cartridge and an cartridge accommodating portion. An ink cartridge includes a cartridge case forming an ink chamber, an ink supply portion, and an air intake portion. The cartridge case includes a front face, a rear face opposite the front face, and a particular face connected to each of the front face and the rear face. The particular face has an opening formed therethrough. The ink supply portion is positioned at the front face and configured to supply ink. The air intake portion is configured to introduce air from the outside of the ink cartridge to the ink chamber. The air intake portion includes a valve, a valve seat, an urging, and an operation member. The cartridge accommodating portion has an accommodating chamber having a wall contacting an operation member.

10 Claims, 8 Drawing Sheets

FOREIGN PATENT DOCUMENTS

| | | | |
|---|---|---|---|
| JP | 2002103642 | A | 4/2002 |
| JP | 2002-200749 | A | 7/2002 |
| JP | 2003-053994 | A | 2/2003 |
| JP | 2003300330 | A | 10/2003 |
| JP | 2004-314600 | A | 11/2004 |
| JP | 2005125741 | A | 5/2005 |
| JP | 2005178348 | A | 7/2005 |
| JP | 2005193636 | A | 7/2005 |
| JP | 2005-231220 | A | 9/2005 |
| WO | 0061373 | A1 | 10/2000 |
| WO | 2005051666 | A1 | 6/2005 |

OTHER PUBLICATIONS

State Intellectual Property Office of the People's Republic of China; Notification of First Office Action on Chinese Patent Application No. 200710167995.0 (counterpart to the above-captioned U.S. patent application) mailed Jun. 12, 2009.

European Patent Office, European Search Report for EP Appl'n No. 07021332.7-1251 (counterpart to the above-captioned US patent appl'n) mailed Apr. 14, 2008.

* cited by examiner

INK CARTRIDGES AND INK SUPPLY SYSTEMS

CROSS-REFERENCE TO RELATED APPLICATIONS

The present application claims priority from Japanese Patent Application No. JP-2006-296159, which was filed on Oct. 31, 2006, the disclosure of which is incorporated by reference in its entirety.

BACKGROUND OF THE INVENTION

1. Field of the Invention

The present invention relates generally to ink cartridges and ink supply systems. In particular, the present invention is directed towards ink cartridges which may be used in combination with ink jet printers, and towards ink supply systems applicable to ink jet printers.

2. Description of Related Art

A known inkjet printer has a recording head from which ink is discharged onto a recording medium, e.g., a sheet of paper, to form images on the recording medium. The recording head is mounted to a carriage, which is configured to reciprocate in a direction perpendicular to a direction in which the recording medium is fed. A known inkjet printer also has an ink tank or an ink cartridge configured to store ink, and to supply ink from the ink tank or the ink cartridge to the recording head. In known inkjet printers, ink cartridges may be removably installed in a cartridge accommodating portion provided on the carriage, or installed in a cartridge accommodating portion at a position separated from the carriage. If the ink cartridges are installed at a position separated from the carriage, ink is supplied from the cartridge accommodating portion to the recording head via a tube.

In a known inkjet printer, the ink cartridge has an ink supply portion configured to supply ink from the inside of the ink cartridge to the recording head, and an air intake portion configured to place the inside of the ink cartridge in fluid communication with the atmosphere when the ink cartridge is installed to the cartridge accommodating portion. Nevertheless, if the air intake portion fails to function as intended, e.g., due to user error, the inside of the ink cartridge may not be in fluid communication with the atmosphere. Moreover, in known inkjet printers, if ink is supplied from the ink cartridge while the inside of the ink cartridge is not in fluid communication with the atmosphere, the pressure inside the ink cartridge may drop.

Furthermore, in a known inkjet printer, the inside of the ink cartridge is depressurized when the ink cartridge is manufactured, and therefore the inside of the ink cartridge is depressurized before the ink cartridge is installed in the printer. In such a case, if fluid communication between the inside of the ink cartridge and the recording head is established via the ink supply portion before fluid communication between the inside of the ink cartridge and the atmosphere via the air intake portion is established, ink may return from the recording head to the ink cartridge because the inside of the ink cartridge is depressurized. If ink returns from the recording head to the ink cartridge, menisci of ink formed in the nozzles of the inkjet head may break, trapping air in the recording head, and resulting in potential printing failure.

Another known inkjet printer has an accommodating portion for an ink cartridge having an ink chamber, an ink supply valve configured to supply ink from the ink chamber, and an air intake portion sealed from the outside of the ink cartridge with a film. The cartridge accommodating portion has a protrusion configured to pierce and break the film, placing the ink chamber in fluid communication with the atmosphere, and an ink supply needle configured to contact and open the ink supply valve to supply ink from the ink chamber. In a known inkjet printer, each of the protrusion and the ink supply needle extends in a direction parallel with the direction in which the ink cartridge is inserted to the cartridge accommodating portion. The protrusion extends further from a base of the cartridge accommodating portion than the ink supply needle extends from the base, and therefore the protrusion pierces and breaks the film before the ink supply needle contacts and opens the ink supply valve.

When the difference between the length of the protrusion and the length of the ink supply needle is small, then when the ink cartridge is inserted to the cartridge accommodating portion at an increased speed, the ink supply needle may contact and open the ink supply valve almost at the same time as when the protrusion pierces and breaks the film, which may cause the return of ink from the recording head. Moreover, when the ink cartridge is inserted to the cartridge accommodating portion at an angled or tilted position, the ink supply needle may contact and open the ink supply valve before the protrusion pierces and breaks the film, which also may cause the return of ink from the recording head.

The protrusion may be lengthened, in an attempt to reduce these problems. Nevertheless, the lengthened protrusion may be broken when the ink cartridge is inserted to the cartridge accommodating portion, especially if the ink cartridge is inserted at an angled or tilted position, which also may result in the return of ink from the recording head.

SUMMARY OF THE INVENTION

A need has therefore arisen for ink cartridges and ink supply systems which overcome these and other shortcomings of the related art. A technical advantage of the present invention is to reliably provide fluid communication between the inside of the ink cartridge and the atmosphere before establishing fluid communication between the inside of the ink cartridge and the recording head.

According to an embodiment of the present invention, an ink cartridge comprises a cartridge case comprising a front face, a rear face opposite the front face, and a particular face connected to the front face and to the rear face, wherein the particular face has an opening formed therethrough, and the cartridge case defines at least a portion of an ink chamber therein. An ink supply portion is positioned at the front face and configured to supply ink from an interior of the ink chamber to an exterior of the ink chamber, and the ink supply portion comprises a valve assembly. An air intake portion is configured to introduce air from the exterior of the ink chamber to the interior of the ink chamber. The air intake portion comprises a particular valve, a particular valve seat, a particular urging member configured to urge the particular valve toward the particular valve seat, and an operation member extending from the particular valve to an exterior of the particular face via the opening, wherein the particular valve is configured to separate from the particular valve seat when an external force is applied to the operation member.

According to another embodiment of the present invention, an ink supply system comprises an ink cartridge and a cartridge accommodating portion. The ink cartridge comprises a cartridge case comprising a front face, a rear face opposite the front face, and a particular face connected to the front face and to the rear face, wherein the particular face has an opening formed therethrough, and the cartridge case defines at least a portion of an ink chamber therein. An ink supply portion is positioned at the front face and configured to supply ink from an interior of the ink chamber to an exterior of the ink chamber, and the ink supply portion comprises a valve assembly. An air intake portion is configured to introduce air from the exterior of the ink chamber to the interior of the ink chamber. The air intake portion comprises a particular valve, a particular valve seat, a particular urging member configured to urge the particular valve toward the particular valve seat, and an operation member extending from the particular valve to an exterior of the particular face via the opening, wherein the particular valve is configured to separate from the particular valve seat when an external force is applied to the operation member. The cartridge accommodating portion comprises an accommodating case, defining an accommodating chamber therein, the accommodating chamber having a first end and a second end opposite the first end, wherein the second end of the accommodating chamber has a second opening formed therethrough, and the accommodating chamber is configured to receive the ink cartridge through the second opening. The accommodating case comprises an ink supply pipe which is positioned at the first end of the accommodating chamber, and is configured to contact the first valve when the ink cartridge is positioned in the accommodating chamber, and a particular wall extending from the first end of the accommodating chamber to the second end of the accommodating chamber, wherein the particular wall comprises an inner surface facing the accommodating chamber, and the inner surface comprises a particular portion adjacent to the second end, and extending toward the first end, wherein the particular portion is configured to slidably engage the operation member when the ink cartridge is inserted into the accommodating chamber.

Other objects, features, and advantages of embodiments of the present invention will be apparent to persons of ordinary skill in the art from the following description of preferred embodiments with reference to the accompanying drawings.

BRIEF DESCRIPTION OF THE DRAWINGS

For a more complete understanding of the present invention, the needs satisfied thereby, and the features and technical advantages thereof, reference now is made to the following descriptions taken in connection with the accompanying drawings.

FIG. 6(*b*) is a cross sectional view of the ink cartridge taken along the VIb-VIb line in FIG. 6(*a*).

DETAILED DESCRIPTION OF EMBODIMENTS

Figure 1:
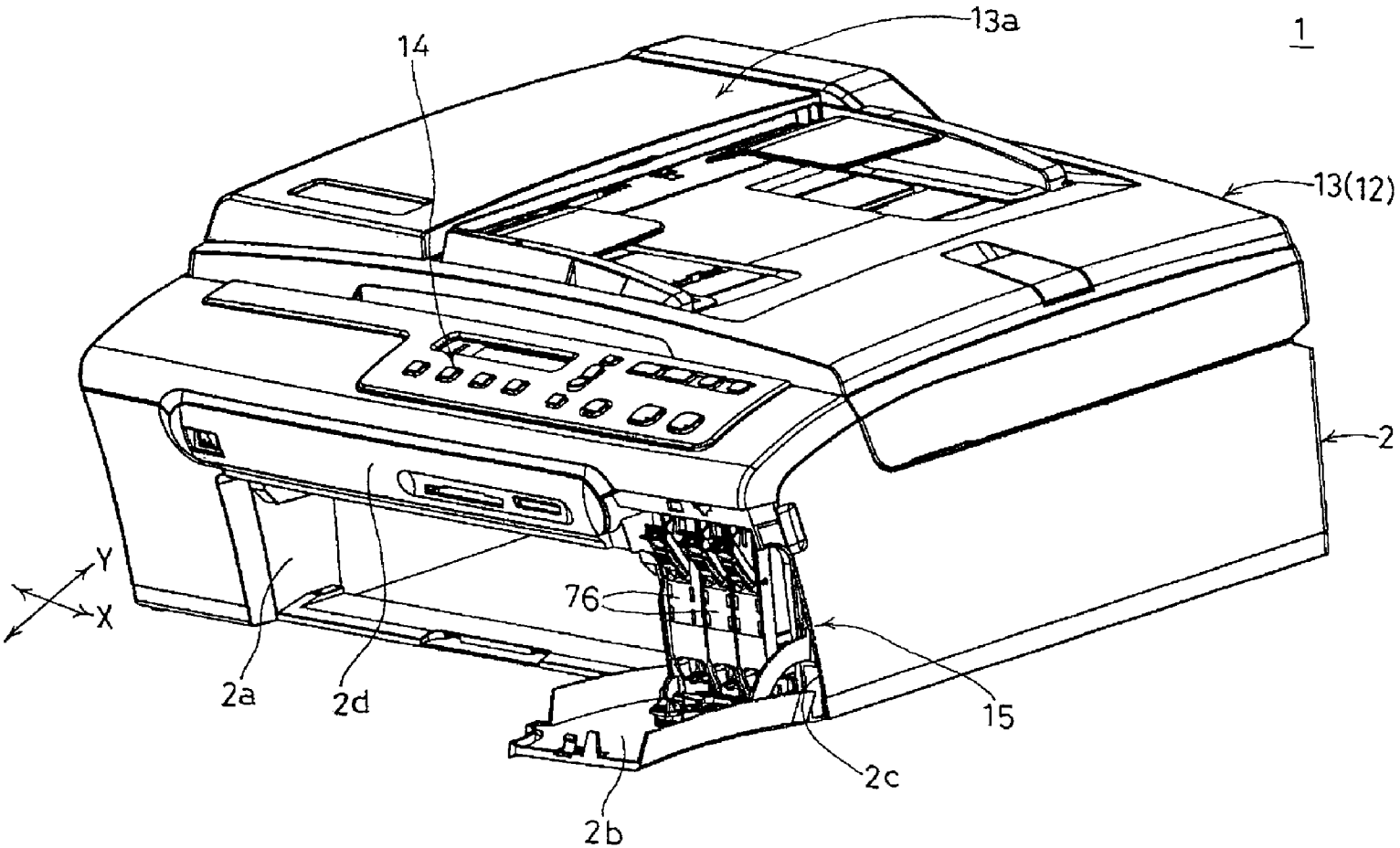
FIG. 1 is a perspective view of a multi functional device, according to an embodiment of the present invention.

FIG. 1 shows a multi functional device 1 according to an embodiment of the present invention. Multi functional device 1 may function as one or more of a printer, copier, scanner, and a facsimile, and may be operably connected to a computer. Multi functional device 1 may be configured to record images or characters on a recording medium, e.g., a sheet of paper, based on image data or character data transmitted from the computer. Multi functional device 1 also may be operably connected to an external apparatus, e.g., a digital camera, and record images on a recording medium based on image data transmitted from the external device.

Figure 2:
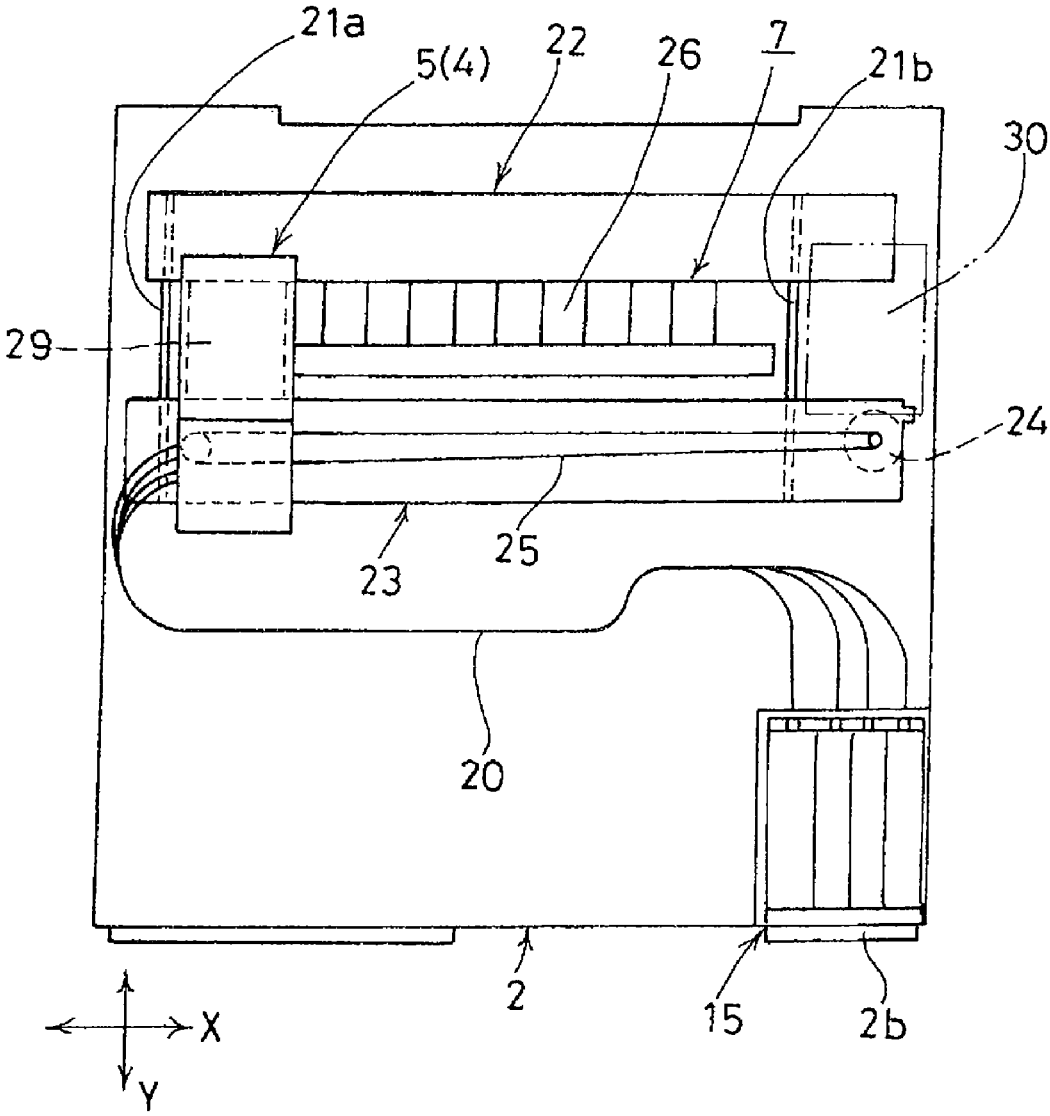
FIG. 2 is top view of the multi functional device of FIG. 1, when a top portion thereof is removed.
Figure 3:
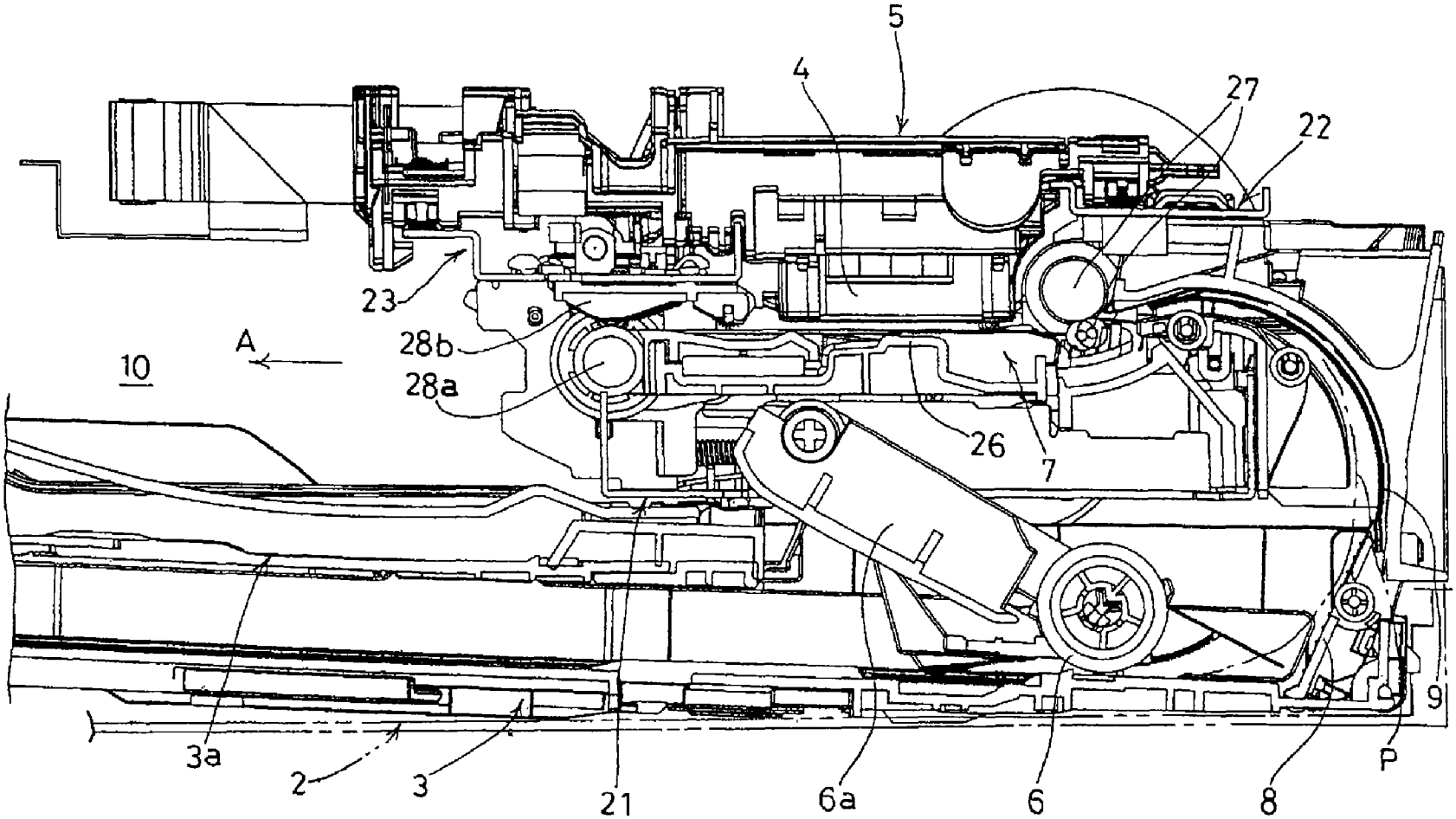
FIG. 3 is a cross sectional side view of a main portion of the multi functional device of FIG. 1.

Referring to FIG. 1, FIG. 2, and FIG. 3, multi functional device 1 may comprise a case 2, a printer portion 7, a paper cassette 3 (not shown in FIG. 1), and a paper discharge portion 10. Each of printer portion 7, paper cassette 3, and paper discharge portion 10 may be disposed within case 2, and case 2 may comprise at least one resin, e.g., a synthetic resin. Paper discharge portion 10 may be formed above paper cassette 3, and paper cassette 3 may be positioned below printer portion 7. Case 2 may have an insertion opening 2*a* formed therethrough at the front of case 2, and paper cassette 3 may be configured to be inserted into and removed from case 2 through insertion opening 2*a*, in a substantially horizontal direction. Case 2 may have a front side in which insertion opening 2*a* is formed, a rear side opposite the front side, and a left side and a right side each connected to each of the front side and the rear side. A slot portion 2*d* may be provided at the front side of case 2, above insertion opening 2*a*, and may be configured to receive and mount a memory medium, e.g., a memory card. Multi functional device 1 may be configured to record images on a recording medium, based on image data stored in the memory medium.

Multi functional device 1 further may comprise an image reading portion, e.g., a scanner portion, 12, which may comprise a Contact Image Sensor ("CIS"), and may be disposed above case 2. Image reading portion 12 may be configured to read images from an original document, to be used for the copy function or the facsimile function. Multi functional device 1 further may comprise an operation panel 14, which may be disposed in front of scanner portion 12, and above case 2, and a cartridge accommodating portion 15, which may be disposed substantially at the front of case 2 and to the right of discharge portion 10. Case 2 may comprise an opening 2*c*, formed therethrough at the front of case 2, and a cover 2*b*. The lower end of cover 2*b* may be supported at the lower end of opening 2*c*, such that cover 2*b* may pivot about the lower end. When cover 2*b* pivots forward, downward, and lies down, cover 2*b* may be configured to expose cartridge accommodating portion 15 through opening 2*c*. When cover 2*b* pivots upward, rearward, and sits upright, cover 2*b* may be configured to cover cartridge accommodating portion 15.

Multi functional device 1 further may comprise a glass plate positioned over image reading portion 12, and may be configured to receive a document, e.g., an original document, thereon. Image reading portion 12 may be configured to reciprocate below the glass plate in an X direction, e.g., a direction which is perpendicular to the plane of the paper of FIG. 3. Multi functional device 1 further may comprise a cover member 13, connected to case 2, and configured to pivot about the right edge of cover member 13 to cover the glass plate from above. Cover member 13 also may comprise an Automatic Document Feeder ("ADF") 13*a*.

Paper cassette 3 may be configured to accommodate stacked sheets of paper P, and paper P may be aligned with the shorter sides parallel to the X-direction. Paper P may be various sizes, e.g., A4, Legal, Letter, or others. Paper cassette 3 may comprise an auxiliary cassette 3*a*, positioned at the top of paper cassette 3, and configured to accommodate smaller sized sheets of paper P. The auxiliary cassette 3*a* may be configured to move back and forth with respect to paper cassette 3.

Multi functional device 1 further may comprise a separation plate 8 positioned in the rear of paper cassette 3, and an arm 6*a* positioned above paper cassette 3. Arm 6*a* may be pivotally supported at its upper end, and may comprise a feed roller 6 positioned at its lower end. Separation plate 8 and feed roller 6 may be configured to work together to separate one sheet from the sheets of paper P, which may be staked in paper cassette 3 or auxiliary cassette 3*a*, and to feed the sheets of paper P one at a time. The sheet of paper P fed by separation plate 8 and feed roller 6 may be transferred to printer portion 7, which may be disposed above paper cassette 3 via a U-shaped paper path 9.

Paper discharge portion 10 may be disposed above auxiliary cassette 3*a*, and the sheet of paper P on which images are recorded by printer portion 7 may be discharged to paper discharge portion 10, with the surface on which the images are recorded facing upward. The sheet of paper P may be taken out of paper discharge portion 10 by a user, through the upper portion of insertion opening 2*a*.

Figure 4:
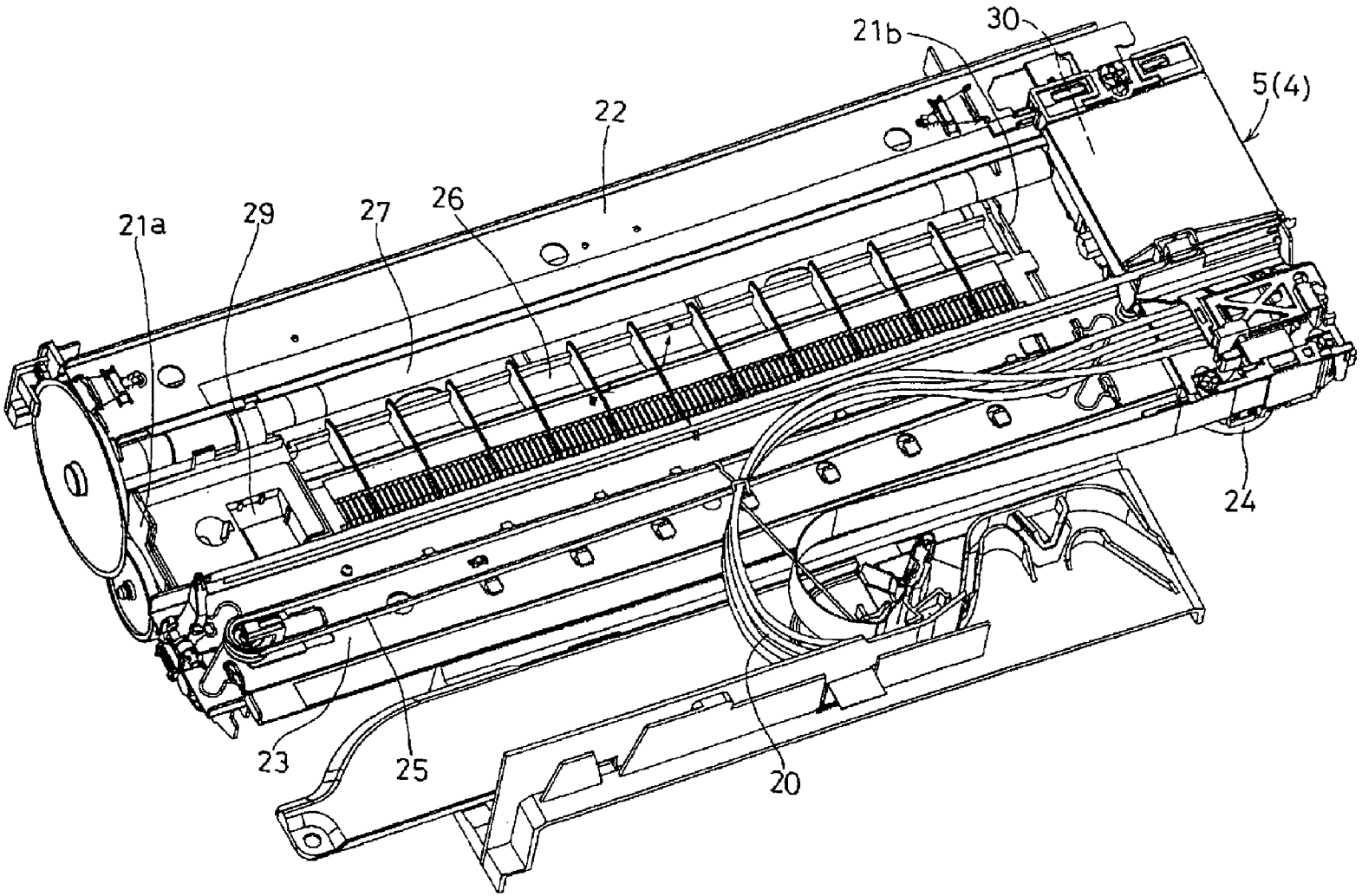
FIG. 4 is a perspective view of a printer portion of the multi functional device of FIG. 1.

Referring to FIG. 2 and FIG. 4, printer portion 7 may comprise an inkjet head 4 mounted on a carriage 5, a main frame 21, a first guide member 22 and a second guide member 23 supported by main frame 21 and supporting carriage 5, a timing belt 25 connected to carriage 5, a motor 24 coupled to timing belt 25 and configured to move timing belt 25, and a platen 26 positioned below inkjet head 4 and configured to support a sheet of paper P. Motor 24 may be a DC motor or a stepping motor. Main frame 21 may comprise a left side wall 21*a* and a right side wall 21*b* opposite left side wall 21*a*. Each of first guide member 22 and second guide member 23 may have a thin plate shape extending in the X-direction, and may supported by left side wall 21*a* and right side wall 21*b* at their ends.

Carriage 5 may be supported by first guide member 22 and second guide member 23, and configured to slide along first guide member 22 and second guide member 22. Timing belt 25 may be a continuous endless belt extending above and parallel to second guide member 23, and coupled to a pulley and the shaft of motor 24. When motor 24 receives a driving force, timing belt 25 may move, and carriage 5 may reciprocate accordingly. Printer portion 7 further may comprise a tape scale extending in the X-direction. The tape scale may be a component of an optical linear encoder provided in multi functional device 1, and may be configured to detect a position and a speed of carriage 5 in the X-direction.

Referring to FIG. 3, multi functional device 1 further may comprises a pair of registration rollers 27 on the upstream side of platen 26 in the paper path 9. Registration rollers 27 may be configured to nip, e.g., contact and cause to move, and transfer a sheet of paper P to a position between platen 26 and a nozzle surface provided on the bottom surface of inkjet head 4. Multi functional device 1 further may comprise a discharge roller 28*a* and a spur 28*b*. Discharge roller 28*a* and spur 28*b* may be positioned on the downstream side of platen 26 in the paper path 9. Discharge roller 28*a* may be configured to contact the sheet of paper P from below, and spur 28*b* may be configured to contact the sheet of paper P from above, and both discharge roller 28*a* and spur 28*b* may be configured to discharge the sheet of paper P to paper discharge portion 10.

Referring to FIG. 2, multi functional device 1 further may comprise an ink receiving portion 29 disposed on the left side of platen 26, and a maintenance unit 30 disposed on the right side of platen 26. Carriage 5 may be configured to move to ink receiving portion 29 periodically during operation of inkjet head 4, such that inkjet head 4 faces ink receiving portion 29. Inkjet head 4 may be configured to perform flushing, e.g., discharging ink to ink receiving portion 29 when inkjet head 4 faces ink receiving portion 29, which may reduce the likelihood of nozzle clogging. Carriage 5 may be configured to stay at a position where inkjet head 4 faces maintenance unit 30, when inkjet head 4 is waiting for next operation, e.g., not performing printing. Maintenance unit 30 may be configured to draw ink from inkjet head 4 through the nozzles in order to eliminate air trapped in inkjet head 4, or to eliminate thickened ink from inkjet head 4. Maintenance unit 30 may comprise a wiper, and the wiper may be configured to wipe the nozzle surface of inkjet head 4, when carriage 5 moves from the position where inkjet head 4 faces maintenance unit 30, to a position where inkjet head 4 faces platen 26.

Figure 5:
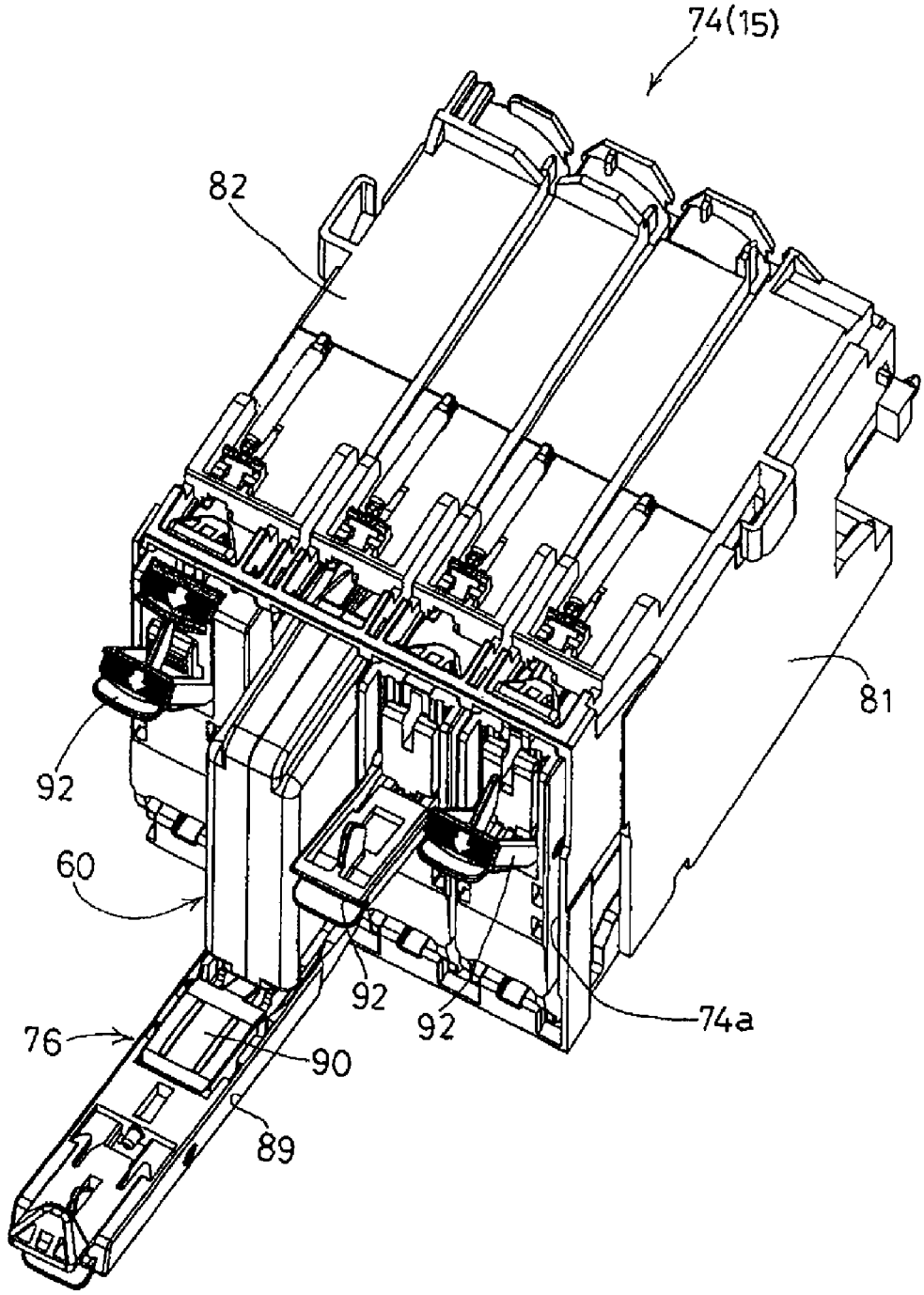
FIG. 5 is a perspective view of an ink supply system, according to an embodiment of the present invention.
Figure 8:
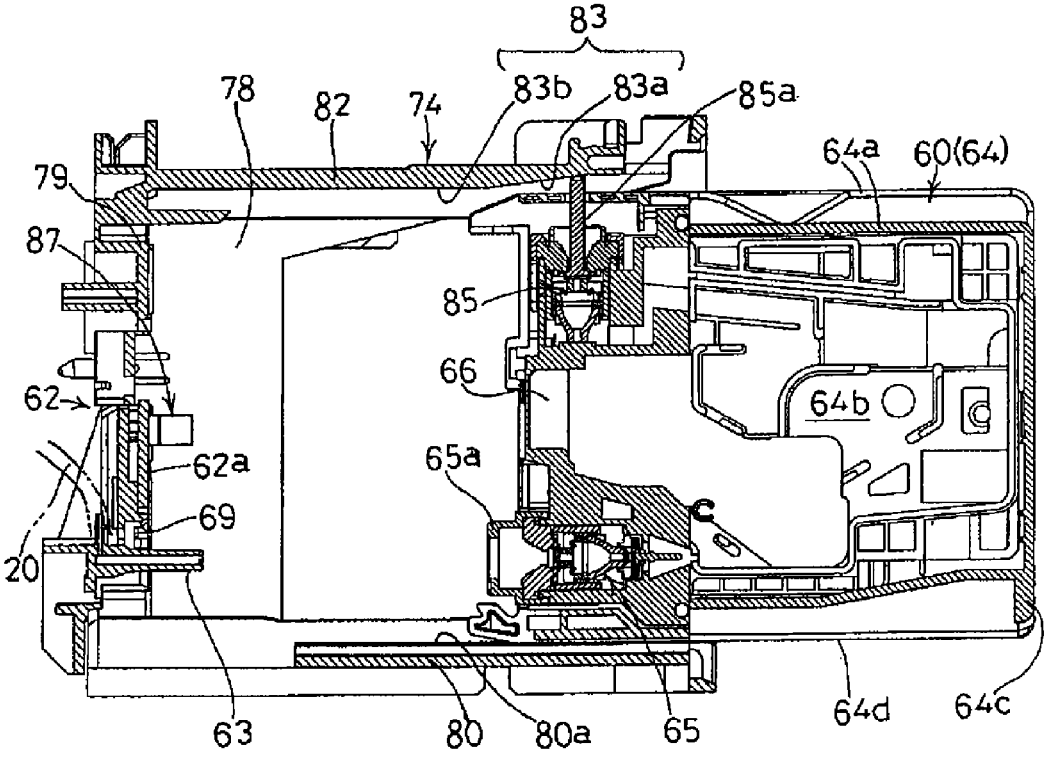
FIG. 8 is a cross sectional view of the ink supply system taken along the VIII-VIII line in FIG. 7.

Referring to FIGS. 5 and 8, an ink supply system according to an embodiment of the present invention may comprise cartridge accommodating portion 15, and at least one ink cartridge 60. Cartridge accommodating portion 15 may comprise an accommodating case 74 configured to accommodate one or more ink cartridges 60, e.g. four ink cartridges 60 aligned in the X-direction. Four ink cartridges 60 may store four colors of inks, e.g., such as a black ink, a cyan ink, a magenta ink, and a yellow ink, respectively. Accommodating case 74 may comprise at least one resin, and may be manufactured using injection molding.

Accommodating case 74 may have a rectangular parallelepiped shape, and may comprise a bottom wall 80, a pair of side walls 81 extending upward from the left and right ends of bottom wall 80, respectively, a top wall 82 connected to the top ends of side walls 81, and a rear wall 79 connected to each of top wall 82 and side walls 81. Accommodating case 74 may comprise an accommodating chamber 78 defined inside bottom wall 80, side walls 81, top wall 82, and rear wall 79. Accommodating chamber 78 may be configured to accommodate ink cartridges 60. Accommodating case 74 may have an opening 74*a* at one end, opposite from rear wall 79, and ink cartridge 60 may be inserted into or removed from accommodating chamber 78 through opening 74*a*. Accommodating case 74 may comprise a plurality of, e.g. four doors 76 corresponding to four ink cartridges 60, respectively. The lower end of each door 76 may be supported at the lower end of opening 74*a*, such that door 76 may pivot about the lower end of door 76. When door 76 pivots forward, downward, and lies down, door 76 may be configured to expose accommodating chamber 78 through opening 74*a*, when door 76 is opened._ When door 76 pivots upward, rearward, and sits upright, door 76 may cover a portion of opening 74*a*.

Accommodating case 74 further may comprise a connector 62 connected to each of bottom wall 80 and side walls 81, and positioned below rear wall 79. Connector 62 may comprise a plate portion 62*a*, and a plurality of, e.g., four, ink supply pipes 63, penetrating plate portion 62*a*, and extending in a direction in which ink cartridge 60 is inserted into accommodating chamber 78. In an embodiment, ink cartridge 60 may be inserted into accommodating chamber 78 horizontally, e.g., in a direction perpendicular to the direction of gravitational pull. An end of each ink supply pipe 63 may be connected to a flexible ink tube 20, which may be connected to inkjet head 4. Ink supply pipe 63 may be configured to be inserted into ink cartridge 60, and ink stored in ink cartridge 60 may be supplied to inkjet head 4 via ink supply pipe 63 and ink tube 20. When more than four colors of inks are used, cartridge accommodating portion 15 may be configured to accommodate more than four ink cartridges 60, storing more than four colors of inks respectively, and the number of ink supply pipes 63 and ink tubes 20 is selected according to the number of ink cartridges 60.

Figure 6:
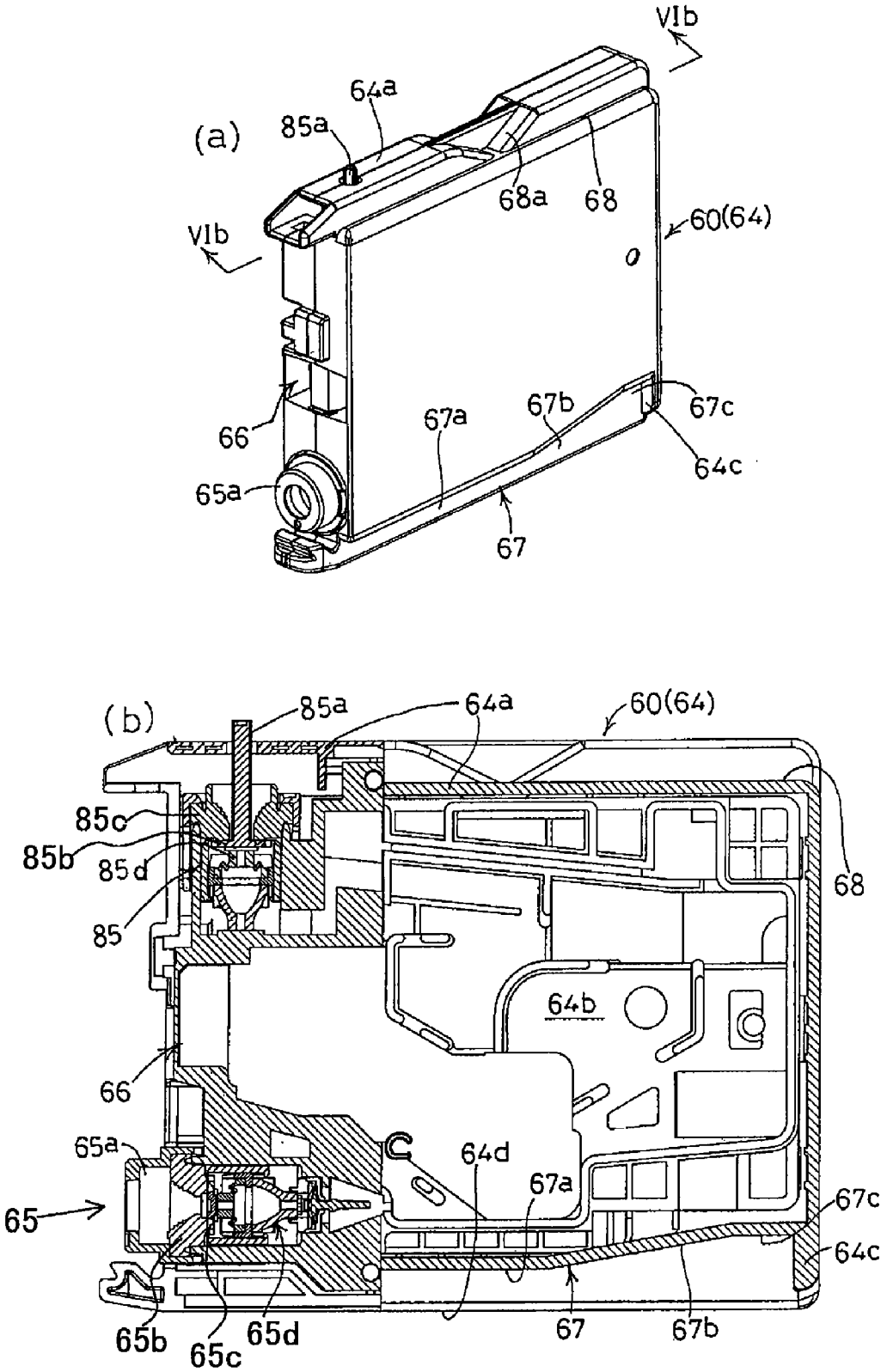
FIG. 6(*a*) is a perspective view of an ink cartridge according to an embodiment of the present invention.
Figure 7:
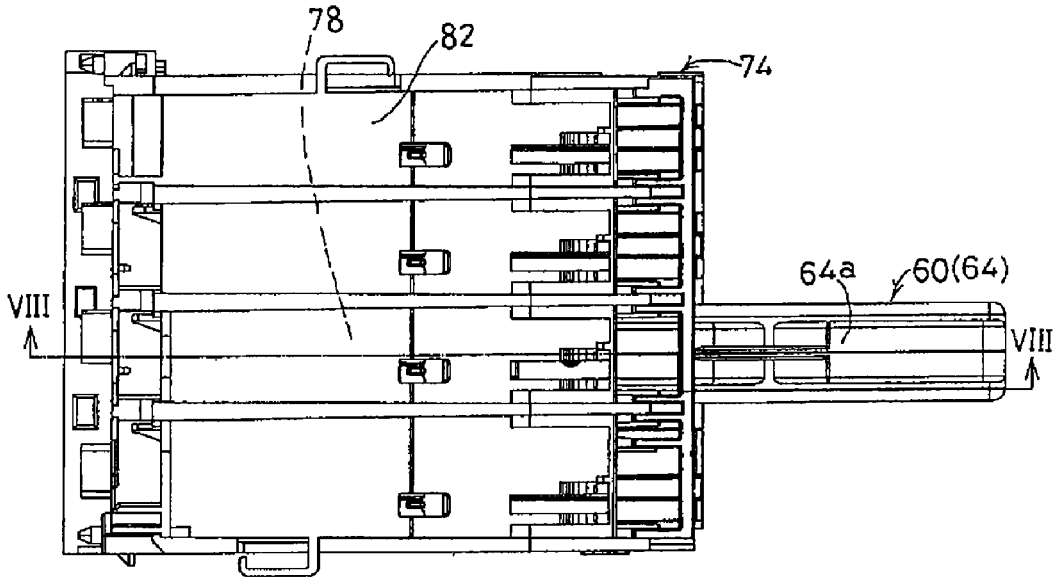
FIG. 7 is a top view of the ink supply system of FIG. 5.

Referring to FIGS. 6(*a*) and 6(*b*), ink cartridge 60 may comprise a cartridge case 64, and an ink chamber 64*b* defined in cartridge case 64 and configured to store ink. Cartridge case 64 may have a substantially rectangular parallelepiped shape and may comprise a front face, a rear face, a top face 64*a*, a bottom face 64*d*, a left side face, and a right side face. The rear face may be positioned opposite from the front face. Top face 64*a* may be connected to each of the front face and the rear face. Bottom face 64*d* may be positioned opposite top face 64*a* and may be connected to both the front face and the rear face. The left side face may be connected to each of the front face, the rear face, top face 64*a*, and bottom face 64*d*, and the right side face, positioned opposite the left side face, may be connected to each of the front face, the rear face, top face 64*a*, and bottom face 64*d*. The front face and the rear face may be substantially perpendicular to each of top face 64*a*, bottom face 64*d*, the left side face, and the right side face.

Cartridge case 64 may have a height, e.g., the distance between top face 64*a* and bottom face 64*d*, a width, e.g., the distance between the left side face and the right side face, and a depth, e.g., the distance between the front face and the rear face. The height may be greater than the width, and the depth may be greater than the height. The width of cartridge case 64 of ink cartridge 60 storing a black ink may be greater than the width of cartridge case 64 of ink cartridge 60, storing an ink other than the black ink because the black ink may be consumed relatively faster than the other color inks. Cartridge case 64 may comprises a left-side member and a right-side member, connected to each other by a connection technique, e.g., welding.

Ink cartridge 60 further may comprise an ink supply portion 65 at the front face of cartridge case 64. Ink supply portion 65 may be positioned closer to a lower end of the front face of cartridge case 64 than to an upper end of the front face of cartridge case 64. Ink supply portion 65 may comprise a cylindrical pipe 65*a* extending outward from the front face of cartridge case 64. Ink supply portion 65 also may comprise a valve seat 65*b*, an ink supply valve 65*c*, and an urging member 65*d*. Ink supply valve 65*c* may be urged by urging member 65*d* toward valve seat 65*b*. Ink supply valve 65*c* may contact valve seat 65*b*, when ink cartridge 60 is not installed in cartridge accommodating portion 15.

Referring to FIG. 8, connector 62 may comprise a plurality of guide ribs 69, extending from plate portion 62*a* in the direction in which in cartridge 60 may be inserted into accommodating chamber 78 of accommodating case 74. Guide ribs 69 may be formed in an arc shape surrounding ink supply pipe 63, and may be configured to contact and guide an outer surface of cylindrical pipe 65*a*, when ink cartridge 60 is installed in accommodating chamber 78. When the installation is completed, ink supply pipe 63 may contact and push ink supply valve 65*c* against the urging force of urging member 65*d*, which may separate ink supply valve 65*c* from valve seat 65*b*, and which may supply ink stored in ink cartridge 60 to inkjet head 4 via ink supply pipe 63 and ink tube 20.

Referring to FIG. 6(*a*), FIG. 6(*b*), and FIG. 8, ink cartridge 60 further may comprise a detection portion 66, positioned at the front face of cartridge case 64. Ink cartridge 60 also may comprise a movable member, configured to move based on an amount of ink in ink chamber 64*b*. A portion of the movable member may be positioned within detection portion 66. Cartridge accommodating portion 15 further may comprise a sensor 87, e.g., a photo interrupter, disposed at the rear side of accommodating case 74, and sensor 87 may be positioned adjacent to detection portion 66 when ink cartridge 60 is installed in accommodating chamber 78. Sensor 87 may be configured to detect whether a portion of the movable member is positioned within detection portion 66, and multi functional device 1 may determine the amount of ink remaining in ink cartridge 60 based on the signal of sensor 87.

Ink cartridge 60 further may comprise an air intake portion 85, disposed adjacent to the corner between top face 64*a* and the front face of cartridge case 64. Air intake portion 85 may comprise an urging member 85*d* and a valve seat 85*c*, and urging member 85*b* may urge air intake valve 85*b* towards valve seat 85*c*. When ink cartridge 60 is not installed in cartridge accommodating portion 15, air intake valve 85*b* may contact valve seat 85*c*, and a fluid communication between ink chamber 64*b* and the outside of ink cartridge 60 via air intake portion 85 may be prohibited. Air intake portion 85 also may comprise an operation member 85*a* formed in a cylindrical rod shape. Operation member 85*a* may extend from air intake valve 85*b*, and may protrude from top face 64*a* through an opening formed through top face 64*a*, in a direction perpendicular to top face 64, and in a direction perpendicular to the direction in which ink cartridge 60 is inserted into accommodating chamber 78.

The inner surface of top wall 82 may comprise a first portion 83*a* and a second portion 83*b*. First portion 83*a* may extend from opening 74*a* of accommodating case 74, toward the rear side of accommodating case 74, and second portion 83*b* may extend from an end of first portion 83*a* to rear wall 79 of accommodating case 74. First portion 83*a* may slant with respect to second portion 83*b*. First portion 83*a* may slant downward or toward accommodating chamber 78 continuously, from a first end of first portion 83*a* connected to opening 74*a*, to a second end of first portion 83*a* connected to second portion 83*b*. Second portion 83*b* may extend flatly and horizontally in parallel with the direction in which ink cartridge 60 is inserted into accommodating chamber 78. Second portion 83*b* also may extend in parallel with top face 64*a* of cartridge case 64 when the ink cartridge 60 is installed in accommodating chamber 78.

When ink cartridge 60 is inserted, operation member 85*a* first may contact first portion 83*a* of inner surface of top wall 82. When ink cartridge 60 is further inserted, operation member 85*a* may be pushed further downward by first portion 83*a*, towards the inside of ink cartridge 60, because first portion 83*a* slants downward, toward accommodating chamber 78. When operation member 85*a* is pushed downward, toward the inside of ink cartridge 60, air intake valve 85*b* may separate from valve seat 85*c*, acting against the urging force of urging member 85*d*. This separation may establish fluid communication between ink chamber 64*b* and the outside of ink cartridge 60 via air intake portion 85. When ink cartridge 60 is still further inserted, fluid communication between ink chamber 64*b* and the outside of ink cartridge 60 may continue, because second portion 83*b* may continue to push operation member 85*a*. When ink cartridge 60 is yet further inserted, ink supply pipe 63 may enter cylindrical pipe 65*a*, and may contact and push ink supply valve 65*c*, against the urging force of urging member 65*d*, and ink supply valve 65*c* may separate from valve seat 65*d*.

While inkjet head 4 performs printing, ink may be supplied from ink cartridge 60 to inkjet head 4, and air may enter ink chamber 64*b* via air intake portion 85. Operation member 85*a* may protrude from top face 64*a*, which is different than the front face at which ink supply portion 65 may be positioned. Therefore, operation member 85*a* and ink supply valve 65*c* may be pushed at different times. Moreover, operation member 85*a* may protrude from top face 46*a* at a position closer to the front face than to the rear face of cartridge case 64. Operation member 85*a* may be pushed at a first stage of the installation of ink cartridge 60 into accommodating chamber 78, which may establish fluid communication between ink chamber 64*b* and the outside of ink cartridge 60 via air intake portion 85. In contrast, ink supply pipe 63 may push ink supply valve 65*c* at a later or at the last stage of the installation, which may reliably establish fluid communication between the ink chamber 64*b* and the atmosphere before establishing fluid communication between ink chamber 64*b* and inkjet head 4. This may reduce the likelihood of ink returning from inkjet head 4 to ink cartridge 60.

Ink cartridge 60 further may comprise guide grooves 67 formed at the boundary between the left side face of cartridge case 64 and bottom face 64*d* of cartridge case 64, and at the boundary between the right side face of cartridge case 64 and bottom face 64*d* of cartridge case 64. Guide grooves 67 may extend from the front face of cartridge case 64 towards the rear face of cartridge case 64. Each guide groove 67 may comprise a shallow groove portion 67*a*, an intermediate groove portion 67*b*, and a deep groove portion 67*c*. The length of shallow groove portion 67*a* may be less than the length of the deep groove portion 67*c*, in the height direction of cartridge case 64. One end, e.g., a first end, of intermediate groove portion 67*b* may be connected to shallow groove portion 67*a*, and the other end, e.g., a second end, of intermediate groove portion 67*b*, opposite the first end, may be connected to deep groove portion 67*c*.

The length of intermediate groove portion 67 in the height direction of cartridge case 64 may continuously increase from the first end of intermediate groove portion 67*b* to the second end of intermediate groove portion 67*b*. Protrusion 64*c* may extend outward from each guide groove 67 adjacent to the rear face of cartridge case 64. A pair of guide rails 80*a* may be formed on bottom wall 80 of accommodating case 74. Guide rails 80*a* may extend from opening 74*a*, toward connector 62. When ink cartridge 60 is inserted into accommodating chamber 78, guide rails 80*a*, and guide grooves 67, facing guide rails 80, may guide ink cartridge 60 into position.

Ink cartridge 60 further may comprise upper grooves 68 formed at the boundary between the left side face of cartridge case 64 and top face 64*a* of cartridge case 64, and the boundary between the right side face of cartridge case 64 and top face 64*a* of cartridge case 64. Upper grooves 68 may extend from the front face of cartridge case 64 to the rear face of cartridge case 64. Ink cartridge 60 also may comprise a V-shaped recess 68*a* in top face 64*a*, in an intermediate position in the depth direction of cartridge case 64.

Referring to FIG. 5, door 76 may comprise a door body 89, a movable member 90, and a spring positioned between and configured to couple door body 89 to movable member 90. When ink cartridge 60 is installed in accommodating chamber 78 and door 76 is closed, movable member 90, aided by the urging force of the spring, may press ink cartridge 60 towards rear wall 79 and connector 62, which may cause door 76 to securely retain ink cartridge 60. When ink cartridge 60 is to be removed from accommodating chamber 78, door 76 may be opened. When door 76 is opened and pivots forward and downward, a pair of claws provided on door 76 may contact protrusions 64*c*, and the claws may pull ink cartridge 60 out.

In another embodiment, operation member 85*a* may protrude from the left or right side face of cartridge case 64 through an opening formed through the left or right side face of cartridge case 64, in a direction perpendicular to the left and right side face of cartridge case 64, and also in a direction perpendicular to the direction in which ink cartridge 60 is inserted into accommodating chamber 78. In this case, the inner surface of top wall 82 may be substantially flat, and accommodating case 74 may comprise a further wall extending from opening 74*a* to rear wall 79 and connector 62. The further wall may be configured to face the left or right side face of cartridge case 64 when ink cartridge 60 is installed in accommodating chamber 78. The inner surface of the further wall may comprise a first portion and a second portion. The first portion may extend from opening 74*a* of accommodating case 74 toward the rear side of accommodating case 74, and the second portion may extend from an end of the first portion to rear wall 79 and connector 62. The first portion may slant with respect to the second portion. The first portion may slant toward accommodating chamber 78 continuously, from a first end of the first portion connected to opening 74*a* to a second end of the first portion. The second portion may extend flatly, in a direction parallel to the direction in which ink cartridge 60 is inserted into accommodating chamber 78. The second portion also may extend in a direction parallel to the left or right side face of cartridge case 64, when the ink cartridge 60 is installed in accommodating chamber 78.

In yet another embodiment, an accommodating case, may comprise an opening formed at a top end of the accommodating case and an ink supply pipe extending from a bottom end of the accommodating case toward the opening. An ink cartridge may be configured to be inserted into the accommodating case in the vertical direction, e.g., in the direction of gravitational pull. In still another embodiment, an accommodating case may be mounted to a carriage.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. An ink cartridge comprising:

a cartridge case comprising a front face, a rear face opposite the front face, and a particular face connected to the front face and to the rear face, wherein the particular face has an opening formed therethrough and the opening is positioned closer to the front face than to the rear face, wherein the cartridge case defines at least a portion of an ink chamber therein and the ink chamber is configured to store ink therein;

an ink supply portion comprising a valve assembly, positioned at the front face, and configured to supply ink from an interior of the ink chamber to an exterior of the ink chamber; and an air intake portion configured to introduce air from the exterior of the ink chamber to the interior of the ink chamber, wherein the air intake portion comprises:

a particular valve;

a particular valve seat;

a particular urging member configured to urge the particular valve toward the particular valve seat; and an operation member extending from the particular valve to an exterior of the particular face via the opening, wherein the particular valve is configured to separate from the particular valve seat when an external force is applied to the operation member.

2. The ink cartridge of claim 1, wherein the front face comprises a first end and a second end opposite the first end, and wherein the ink supply portion is positioned closer to the second end of the front face than to the first end of the front face, and the particular face is connected to the first end of the front face.

3. The ink cartridge of claim 1, wherein the valve assembly comprises:

a further valve;

a further valve seat; and a further urging member configured to urge the further valve toward the further valve seat.

4. An ink supply system comprising:

an ink cartridge comprising:

a cartridge case comprising a front face, a rear face opposite the front face, and a particular face connected to each of the front face and the rear face, wherein the particular face has a first opening formed therethrough, and the cartridge case defines at least a portion of an ink chamber therein;

an ink supply portion positioned at the front face and configured to supply ink from an interior of the ink chamber to an exterior of the ink chamber, wherein the ink supply portion comprises:

a first valve;

a first valve seat; and a first urging member configured to urge the first valve toward the first valve seat; and an air intake portion configured to introduce air from the outside of the ink cartridge to the ink chamber, wherein the air intake portion comprises:

a second valve;

a second valve seat;

a second urging member configured to urge the second valve toward the second valve seat; and an operation member extending from the second valve to an exterior of the particular face via the first opening, wherein the second valve is configured to separate from the second valve seat when an external force is applied to the operation member; and a cartridge accommodating portion comprising an accommodating case, the accommodating case defining an accommodating chamber therein, the accommodating chamber having a first end and a second end opposite the first end, wherein the second end of the accommodating chamber has a second opening formed therethrough, and the accommodating chamber is configured to receive the ink cartridge through the second opening, wherein the accommodating case comprises:

an ink supply pipe which is positioned at the first end of the accommodating chamber, and is configured to contact the first valve when the ink cartridge is positioned in the accommodating chamber; and a particular wall extending from the first end of the accommodating chamber to the second end of the accommodating chamber, wherein the particular wall comprises an inner surface facing the accommodating chamber, and the inner surface comprises a particular portion adjacent to the second end, and extending toward the first end, wherein the particular portion is configured to slidably engage the operation member when the ink cartridge is inserted into the accommodating chamber.

5. The ink supply system of claim 4, wherein the first opening is positioned closer to the front face than to the rear face.

6. The ink supply system of claim 4, wherein the inner surface comprises a further portion, wherein the further portion is slanted with respect to the particular portion, a first end of the particular portion is connected to the second end of the accommodating chamber, and a second end of the particular portion is connected to further portion.

7. The ink supply system of claim 6, wherein the particular portion continuously extends toward the accommodating chamber and away from the particular wall, from the first end of the particular portion to the second end of the particular portion.

8. The ink supply system of claim 6, wherein the further portion extends in a direction parallel to a direction in which the ink cartridge is inserted into the accommodating chamber.

9. The ink supply system of claim 4, wherein the particular portion is slanted toward the accommodating chamber from the first end of the particular portion to the second end of the particular portion, and the second end of the particular portion extends further from the particular wall than the first end of the particular portion.

10. The ink supply system of claim 4, wherein the accommodating case further comprises a door configured to selectively cover at least a portion of the second opening, and to expose at least a portion of the accommodating chamber to the outside of the accommodating chamber, via the second opening.

* * * * *